US006574805B1

(12) United States Patent
Liu

(10) Patent No.: US 6,574,805 B1
(45) Date of Patent: Jun. 10, 2003

(54) COLLAPSIBLE SINK DEVICE

(75) Inventor: Jack Liu, 5F-5, No. 10, Ching Shan Road, Taichung (TW)

(73) Assignees: Jack Liu, Taichung (TW); Chau-Ho Chu, Taichung (TW); Kam-Kai Lai, Taichung (TW)

( * ) Notice: Subject to any disclaimer, the term of this patent is extended or adjusted under 35 U.S.C. 154(b) by 0 days.

(21) Appl. No.: 10/142,152

(22) Filed: May 10, 2002

(51) Int. Cl.[7] ..... E03C 1/32
(52) U.S. Cl. ..... 4/643; 4/619; 4/625
(58) Field of Search ..... 4/619, 625, 631, 4/483, 599, 600, 650, 643

(56) References Cited

U.S. PATENT DOCUMENTS 3,915,529 A * 10/1975 Bernier ..... 312/237
4,989,279 A * 2/1991 Powell ..... 4/612
5,182,822 A * 2/1993 Cyr et al. ..... 4/625
6,427,259 B1 * 8/2002 Cawthon ..... 4/650

* cited by examiner

*Primary Examiner*—Gregory L. Huson
*Assistant Examiner*—Amanda Flynn
(74) *Attorney, Agent, or Firm*—Rosenberg, Klein & Lee

(57) ABSTRACT

A collapsible sink device includes a collapsible frame movable between an extended position and a collapsed position and a sink detachably mounted on the collapsible frame. The collapsible frame includes four legs and two foldable plank assemblies each including two planks each pivotally connected with one of the legs so that the foldable plank assemblies are parallel to each other in the extended position and that the planks of each of the foldable plank assemblies overlap in the collapsed position.

9 Claims, 5 Drawing Sheets

COLLAPSIBLE SINK DEVICE

BACKGROUND OF INVENTION

1. Field of Invention

The present invention is related to a collapsible sink device.

2. Related Prior Art

Taiwanese Patent Publication No. 257053 discloses a sink device including a sink 30 detachably mounted on a frame 40. The frame 40 is not collapsible and therefore occupies a lot of space in storage and transportation. The only way to reduce the space occupied by the frame 40 is to disassemble the frame 40 with tools. This is troublesome and time-consuming.

The present invention is therefore intended to obviate or at least alleviate the problems encountered in prior art.

SUMMARY OF INVENTION

It is an objective of the present invention to provide a collapsible sink device including a collapsible frame and a sink detachably mounted on the collapsible frame.

It is another objective of the present invention to provide a collapsible sink device including a collapsible frame and a sink detachably mounted on the collapsible frame wherein the collapsible frame can be easily moved between an extended position and a collapsed position.

According to the present invention, a collapsible sink device includes a collapsible frame movable between an extended position and a collapsed position and a sink detachably mounted on the collapsible frame.

The collapsible frame includes four legs and two foldable plank assemblies each connected between two of the legs so that the foldable plank assemblies are parallel to each other in the extended position.

Each of the foldable plank assemblies includes two planks pivotally connected with each other. Each of the planks is pivotally connected with one of the legs.

The collapsible sink device includes a cross element connected between a pair of the legs so that the cross element is perpendicular to the foldable plank assemblies in the extended position.

The collapsible sink device includes a second cross element connected between a second pair of the legs so that the second cross element is perpendicular to the foldable plank assemblies in the extended position.

The collapsible sink device includes a third cross element connected between the second pair of legs.

The collapsible sink device includes a retainer pivotally mounted on the third cross element between a horizontal position for retaining the collapsible frame in the extended position and a vertical position for allowing movement of the collapsible frame to the collapsed position.

The collapsible sink device includes a fourth cross element connected between the first pair of legs for supporting the retainer in the horizontal position.

The collapsible sink device includes two shutters each pivotally mounted on one of the legs.

Other objects, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings wherein.

DETAILED DESCRIPTION OF EMBODIMENTS

Figure 1:
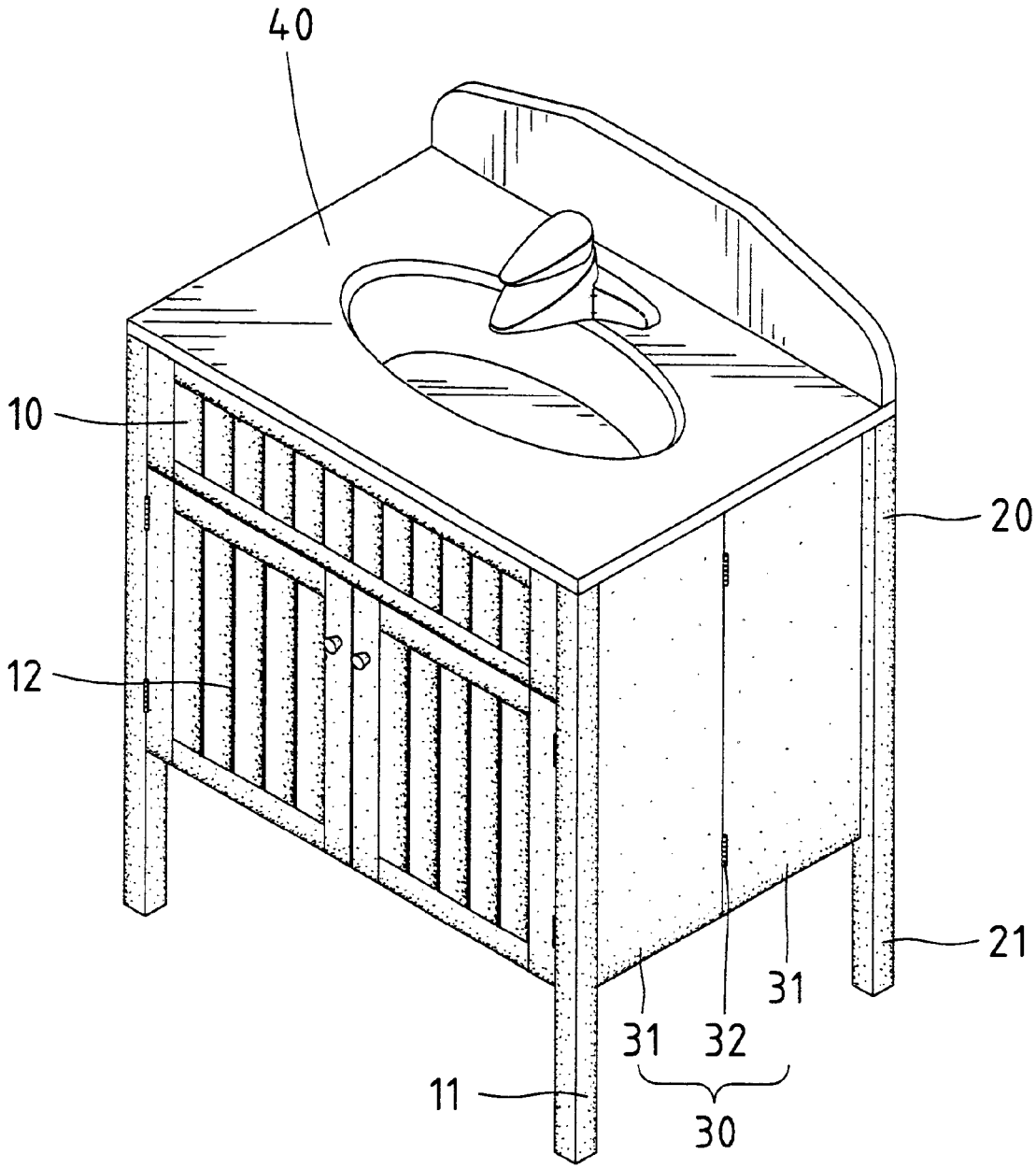
FIG. 1 is a perspective view of a collapsible sink device consisting of a sink and a collapsible frame according to the present invention.

Referring to FIG. 1, a sink device consists of a collapsible frame and a sink 40 detachably mounted on the collapsible frame. The sink 40 is mounted on the collapsible frame in use. The sink 40 can be removed from the collapsible frame in storage and transportation. The collapsible frame can be switched between an extended position shown in FIGS. 1~3 and a collapsed position shown in FIGS. 4 and 5.

Figure 2:
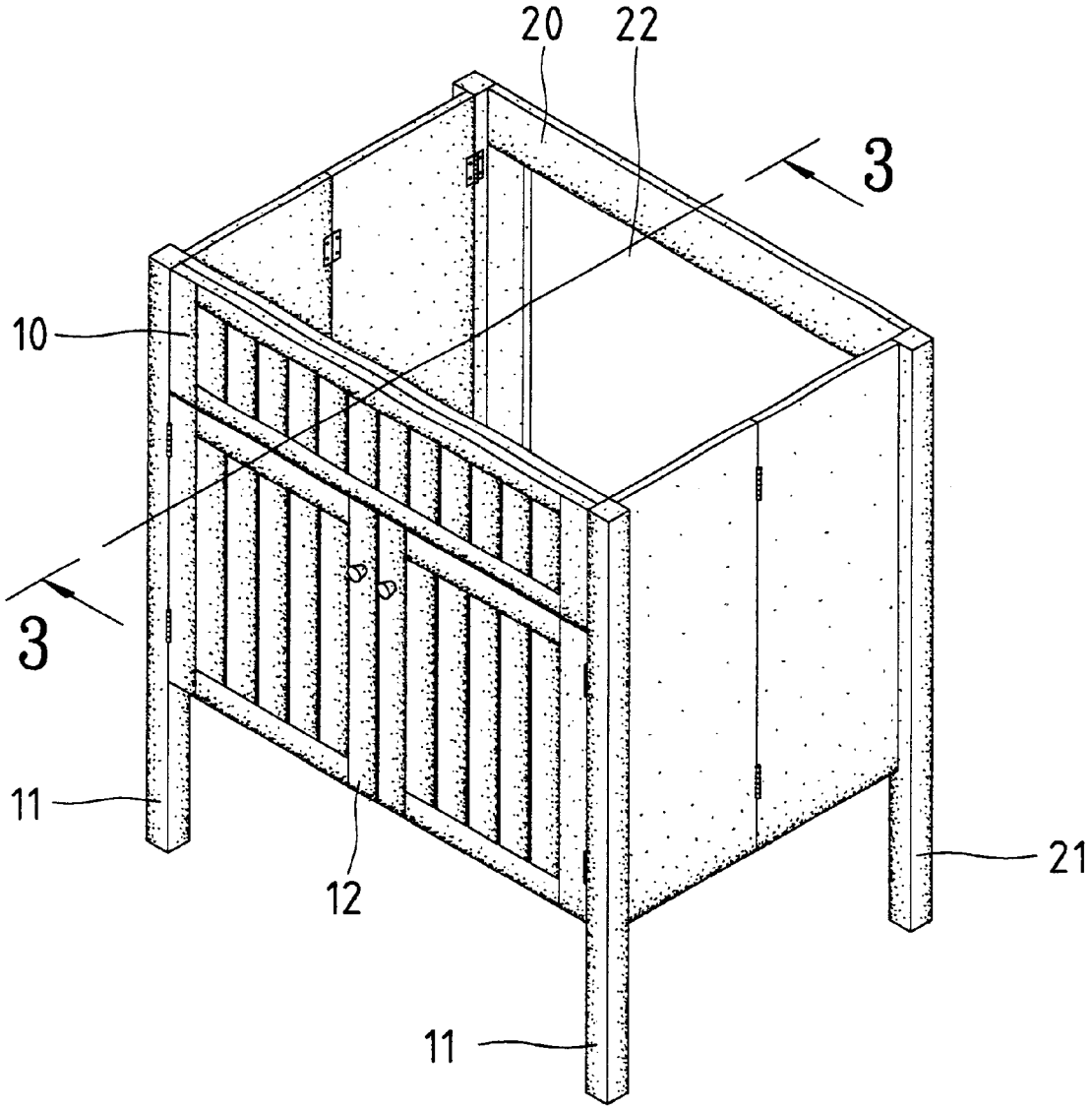
FIG. 2 is similar to FIG. 1 except for showing the sink removed from the collapsible frame.

FIG. 2 shows the collapsible frame alone. The collapsible frame includes two front legs 11 and two rear legs 21 for supporting the collapsible frame on the ground.

A front plank 10 is connected between the front legs 11. A rod 13 is connected between the front legs 11. Between the front plank 10 and the rod 13 are provided two shutters 12. Each of the shutters 12 is pivotally mounted on one of the front legs 11 by means of two hinges (not numbered). A space confined in the collapsible frame can be shut by means of the shutters 12 in order to conceal a piping (not shown) in communication with the sink 40. Of course, the shutters 12 can be pivoted so as to open the space confined in the collapsible frame, thus allowing access to the piping for maintenance and replacement.

Figure 3:
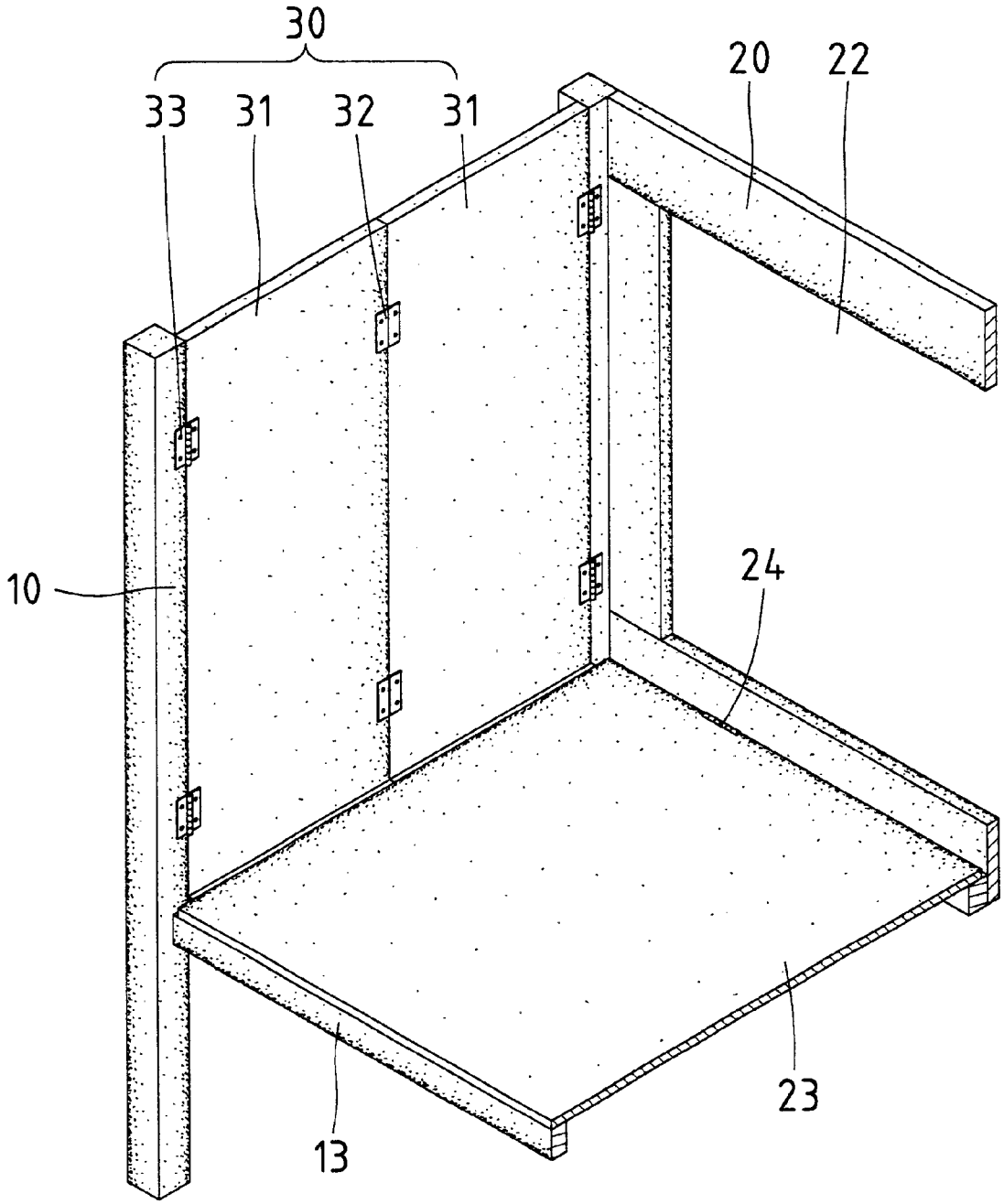
FIG. 3 is a cross-sectional view taken along a line 3—3 in FIG. 2.

Referring to FIG. 3, an upper rear plank 20 and a lower rear plank 24 are connected between the rear legs 21, thus defining a window 22 within them. Through the window 22, the piping can be communicated with a water supply system (not shown) and a water exhaust system (not shown). A retainer 23 in the form of a plank is pivotally mounted on the lower rear plank 24 by means of two hinges 24. When the sink device is in use, the retainer 23 is positioned horizontally in order to retain the collapsible frame in the extended position shown in FIGS. 1~3. In this position, the retainer 23 is supported on the rod 13.

Figure 4:
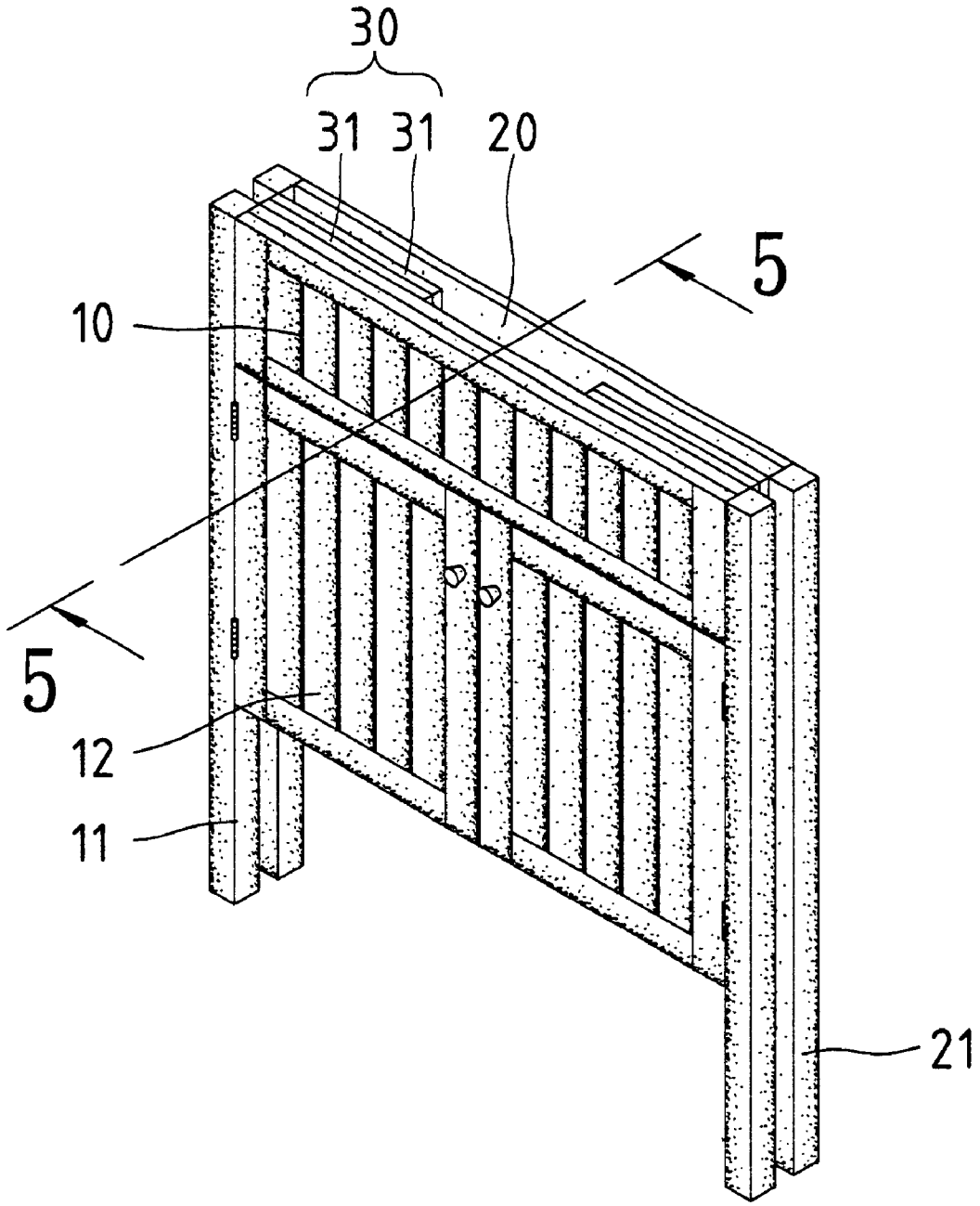
FIG. 4 is similar to FIG. 2 except for showing the collapsible frame in a collapsible position.
Figure 5:
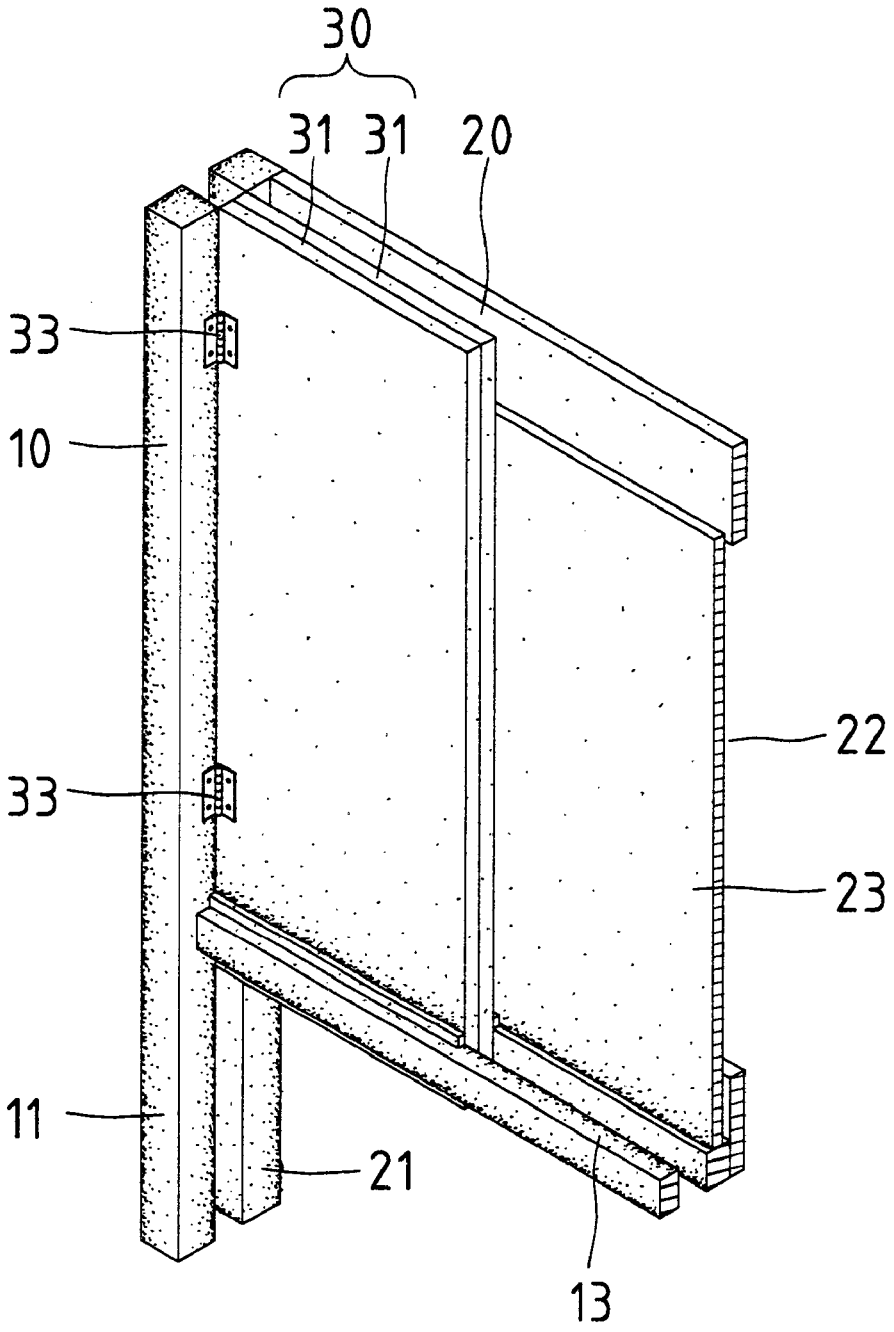
FIG. 5 is a cross-sectional view taken along a line 5—5 in FIG. 4.

The retainer 23 can be pivoted to a vertical position as shown in FIG. 4 so as to allow folding the foldable lateral plank assemblies 30. Thus, the collapsible frame can be moved to the collapsed position shown in FIGS. 4 and 5.

The collapsible frame includes two foldable lateral plank assemblies 30. However, only one of them is shown in FIG. 3 and description will be focused on the one shown in FIG. 3. The foldable lateral plank assembly 30 includes two lateral planks 31 connected with each other by means of two hinges 32. One of the lateral planks 31 is pivotally connected with the front leg 11 by means of two hinges 33, and the remaining one of the lateral planks 31 is pivotally connected with the rear leg 21 by means of two hinges 33.

In accordance with the present invention, the collapsible frame firmly supports the sink 40 in the extended position for use and occupies a small space in the collapsed position for storage and transportation. In addition, the movement of the collapsible frame between the extended position and the collapsed position is simple and easy.

The present invention has been described through detailed illustration of the preferred embodiment. Those skilled in the art can derive many variations from the preferred embodiment without departing from the scope of the present invention. Therefore, the preferred embodiment shall not limit the scope of the present invention. The scope of the present invention is defined in the attached claims.

What is claimed is:

1. A collapsible sink device including a collapsible frame movable between an extended position and a collapsed position and a sink detachably mounted on the collapsible frame, wherein the collapsible frame includes four legs and two foldable plank assemblies each including two planks each pivotally connected with one of the legs so that the foldable plank assemblies are parallel to each other in the extended position and that the planks of each of the foldable plank assemblies overlap in the collapsed position.

2. The collapsible sink device according to claim 1 including a cross element connected between a pair of the legs so that the cross element is perpendicular to the foldable plank assemblies in the extended position.

3. The collapsible sink device according to claim 2 including a second cross element connected between a second pair of the legs so that the second cross element is perpendicular to the foldable plank assemblies in the extended position.

4. The collapsible sink device according to claim 3 including a third cross element connected between the second pair of legs.

5. The collapsible sink device according to claim 4 including a retainer pivotally mounted on the third cross element between a horizontal position for retaining the collapsible frame in the extended position and a vertical position for allowing movement of the collapsible frame to the collapsed position.

6. The collapsible sink device according to claim 5 including a fourth cross element connected between the first pair of legs for supporting the retainer in the horizontal position.

7. The collapsible sink device according to claim 2 including at least one shutter pivotally mounted on one of the legs below the cross element.

8. The collapsible sink device according to claim 7 including two shutters each pivotally mounted on one of the legs.

9. A collapsible sink device including a collapsible frame movable between an extended position and a collapsed position and a sink detachably mounted on the collapsible frame, wherein the collapsible frame includes at least three legs and two foldable plank assemblies each including two planks each pivotally connected with one of the legs so that the planks of each of the foldable plank assemblies overlap in the collapsed position.

* * * * *